US006032306A

United States Patent [19]

Gummin

[11] Patent Number: 6,032,306

[45] Date of Patent: Mar. 7, 2000

[54] SHOWER CURTAIN CONTROL DEVICE

[76] Inventor: Mark A. Gummin, 536 Lexington Ave. #A, El Cerrito, Calif. 94530-3523

[21] Appl. No.: 08/963,628

[22] Filed: Nov. 4, 1997

[51] Int. Cl.[7] ..... A47K 3/22

[52] U.S. Cl. ..... 4/610; 16/87 R; 160/330; 160/DIG. 6; 24/543

[58] Field of Search ..... 16/87.2, 87.4 R; 4/608, 610; 160/330, DIG. 6; 24/543

[56] References Cited

U.S. PATENT DOCUMENTS

| | | | |
|---|---|---|---|
| 2,554,106 | 5/1951 | Heubeck | 4/610 |
| 2,573,985 | 11/1951 | Poter | 4/610 |
| 2,774,974 | 12/1956 | Zaloga | 4/610 |
| 2,878,487 | 3/1959 | Foote | 4/610 |
| 3,872,520 | 3/1975 | Tyconik | 4/610 |
| 4,623,102 | 11/1986 | Hough, Jr. | 24/543 |
| 4,866,818 | 9/1989 | Thompson | 24/543 |
| 5,216,766 | 6/1993 | Lang | 4/610 |
| 5,345,623 | 9/1994 | Dearman | 4/608 |
| 5,345,624 | 9/1994 | Brown, III | 4/610 |

FOREIGN PATENT DOCUMENTS

| | | | |
|---|---|---|---|
| 2514632 | 4/1983 | France | 4/610 |

*Primary Examiner*—Chuck Y. Mah
*Assistant Examiner*—Donald M. Gurley
*Attorney, Agent, or Firm*—Howard Cohen

[57] ABSTRACT

A device for limiting the intrusion of a shower curtain into a shower enclosure includes a clamp portion for releasably engaging the shower curtain rod, and an tail portion depending from the clamp portion for impinging on the shower curtain and urging it outwardly. The clamp includes an inverted U configuration adapted to extend about the curtain rod. The U-configuration includes one leg that is joined integrally to the tail portion, and the other leg is provided with a detent tip. A detent lever extends from the tail portion proximate to the detent tip, and includes an array of closely spaced detent teeth adapted to engage the detent tip. The detent lever is resiliently biased toward the detent tip, so that the tip remains engaged with the teeth unless otherwise disturbed. The two legs of the clamp may be squeezed together to engage the curtain rod frictionally to immobilize the device on the curtain rod, and the device will remain in this disposition until released. The tail portion may comprise an inverted T configuration to engage a wide portion of shower curtain and spread the force of impingement thereabout.

8 Claims, 4 Drawing Sheets

SHOWER CURTAIN CONTROL DEVICE

BACKGROUND OF THE INVENTION

The present invention relates to a shower curtain support device, and more specifically to a device for limiting or preventing the intrusion of a shower curtain into a shower enclosure during use.

It is generally recognized that a shower curtain that forms a portion of a shower enclosure tends to be drawn inwardly into the shower space during shower use. This inward movement of the shower curtain appears to be caused by air flow and pressure differences on opposed sides of the shower curtain. Shower water is typically warmer than the ambient air temperature, and air within the shower enclosure is usually heated by the warm shower spray. The warmed air rises out of the upper opening of the enclosure, and is replaced by cooler ambient air outside the enclosure. The ambient air flows into the enclosure at the bottom of the shower curtain, pushing the curtain inwardly to a significant extent. In an enclosure formed on one or more sides by suspended shower curtains, the space within the enclosure may be substantially reduced by the intrusion of the shower curtains.

This problem has been recognized in the prior art, and many attempts have been made to ameliorate the shower curtain intrusion effect. In one type of device, arm-like members are secured to the shower curtain rod by threaded fasteners secured in holes drilled in the rod. This type of device is difficult to adjust, particularly with wet or soapy hands, and involves permanent alteration of the shower rod. Moreover, these devices may interfere with the sliding suspension of the shower curtain on the rod. Another type of device provides arm-like members secured at the desired angular disposition and spatial separation along the curtain rod by thumbscrews. These fasteners may puncture or distort the shower curtain rod, resulting in permanent damage. Other devices rely on counterweighted arms supported on the shower rod to urge the shower curtain outwardly, but these devices necessarily rely on substantial weights to create the desired effect.

A further prior art device is secured to a shower curtain rod by a strap passed about the rod and adjustably secured by a threaded strap clamp. The clamp adjustment mechanism is operated by rotating the arm which impinges on the shower curtain, and must be closely adjusted to clamp the arm at the desired angle without overtightening and distorting the rod. This task may be difficult for the average shower user, who has wet and soapy hands and cannot grasp and finely control the tubular arm of the device.

Clearly the prior art lacks a simple device for maintaining the desired position and preventing the typical intrusion of a shower curtain into the shower enclosure. The prior art also lacks such a device that is easily secured in place and likewise may be easily released. The prior art is also devoid of such a device that cannot damage the shower rod.

SUMMARY OF THE PRESENT INVENTION

The present invention generally comprises a device for limiting or preventing the intrusion of a shower curtain into a shower enclosure. The device includes an adjustable fastener portion for releasably engaging the shower curtain rod, and an tail portion depending from the fastener portion for impinging on the shower curtain and limiting inward intrusion of the shower curtain.

A salient aspect of the device is the provision of a simple releasable fastener mechanism that permits easy, one-hand deployment and release of the tail that maintains the outward spacing of the shower curtain. The fastener mechanism includes an integral clamp having an inverted U configuration and adapted to extend about the shower curtain rod. The U-configuration includes one leg that is joined integrally to the tail portion, and the other leg is provided with a detent tip. A detent lever extends from the tail portion proximate to the detent tip, and includes an array of closely spaced detent teeth adapted to engage the detent tip. The detent lever is resiliently biased toward the detent tip, so that the tip remains engaged with the teeth unless otherwise disturbed. Thus the two legs of the clamp may be squeezed manually to engage the curtain rod frictionally to the extent required to immobilize the device on the curtain rod, and the device will remain in this disposition until released.

To release the clamp, the distal end of the detent lever is pressed to release the detent tip from engagement with the teeth. The intrinsic resilience of the U-configuration causes the one leg to diverge outwardly, releasing the frictional grip on the curtain rod, and permitting rotational and translational movement of the device with respect to the shower curtain rod.

The tail portion may comprise an inverted T configuration to engage a wide portion of shower curtain and spread the force of impingement thereabout. Alternatively, the tail portion may comprise any desirable shape having a longitudinal extent sufficient to engage the shower curtain and hold it outwardly from the shower area.

DESCRIPTION OF THE PREFERRED EMBODIMENT

Figure 1:
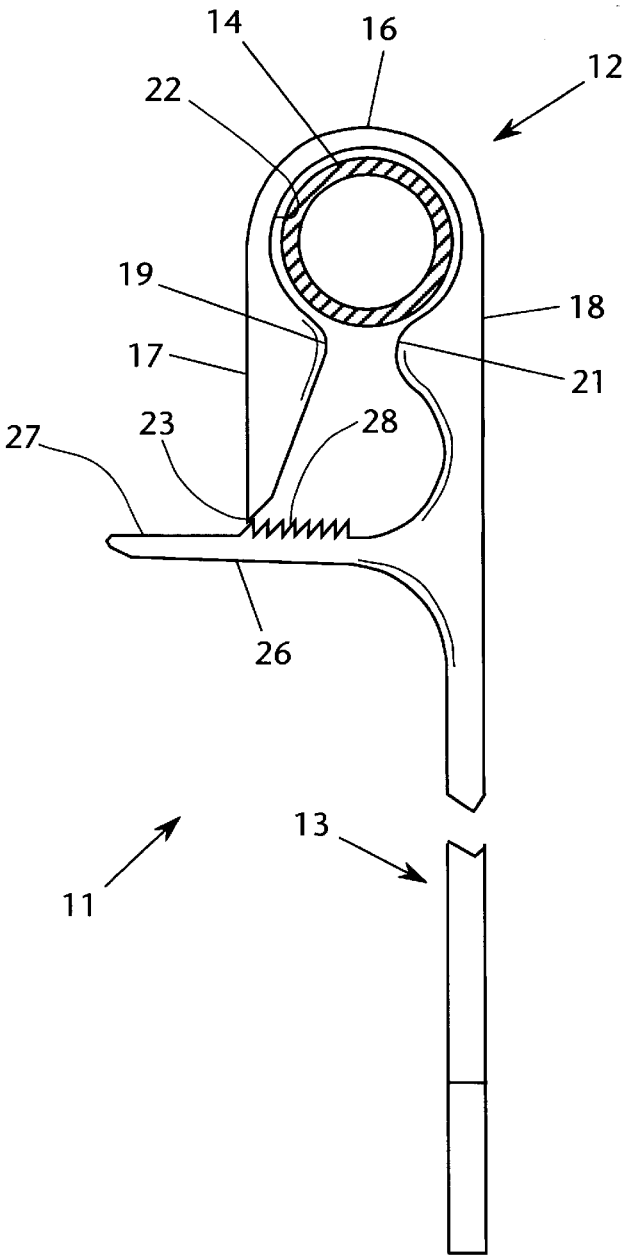
FIG. 1 is a side elevation of the shower curtain control device of the present invention.
Figure 2:
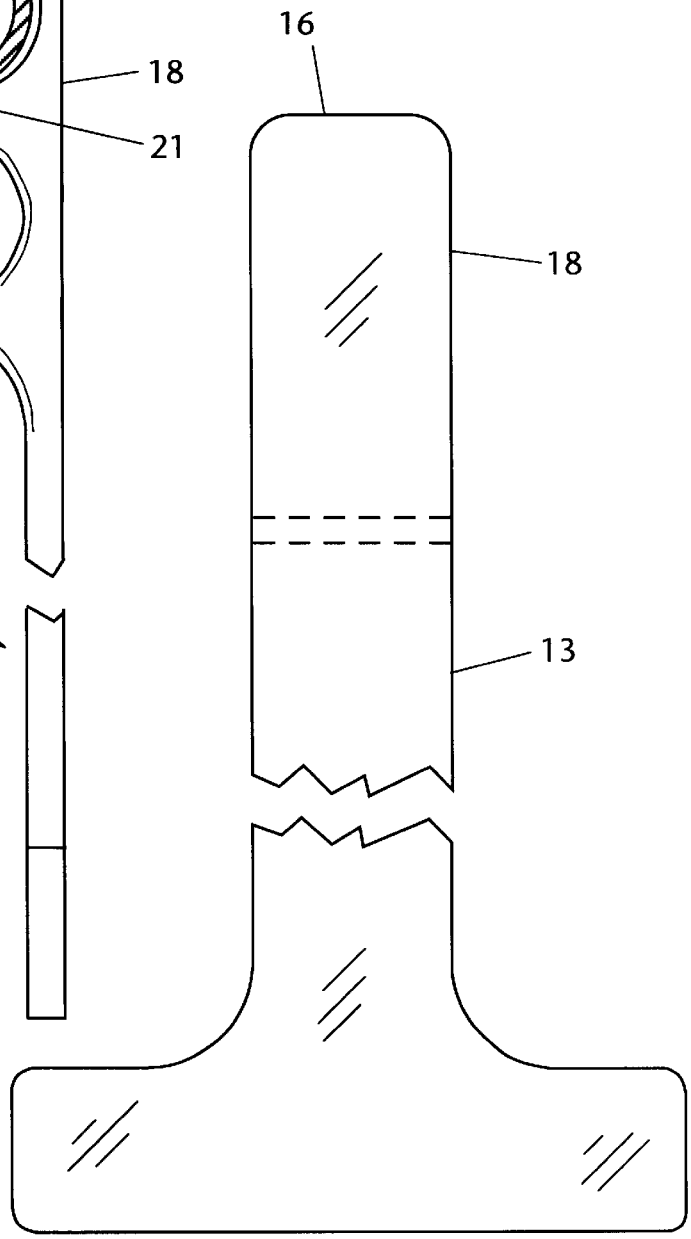
FIG. 2 is a plan view of the shower curtain control device depicted in FIG. 1.

The present invention generally comprises a shower curtain control device for limiting or preventing the intrusion of a shower curtain into a shower enclosure. With regard to FIGS. 1 and 2, the device 11 broadly includes a clamping mechanism 12 for releasably engaging a shower curtain rod 14, and an tail portion 13 depending from the clamping mechanism 12 for impinging on a shower curtain suspended from the rod 14 and limiting intrusion of the curtain into the shower area. Although the invention will be described with regard to an integrally formed, unitary construction, the various components described below may be fashioned singly and joined as disclosed herein.

The clamping mechanism 11 includes a web 16 formed in an inverted U configuration having opposed legs 17 and 18. The inner confronting faces of the legs 17 and 18 are provided with opposed buttresses 19 and 21, respectively, which define a receptacle 22 having a surface extending generally cylindrically and describing more than 180° and less than 360° of arc. The receptacle 22 is dimensioned so that in the quiescent state of the device 11, the diameter of the receptacle 22 is slightly greater than that of the rod 14, whereby the device 11 is received on the rod 14 in freely translating and freely rotating fashion. The receptacle will accommodate various styles of shower rod, such as fluted, faceted, wrapped, and the like. It is preferable that the rod 14 not rotate freely in its supports.

Figure 3:
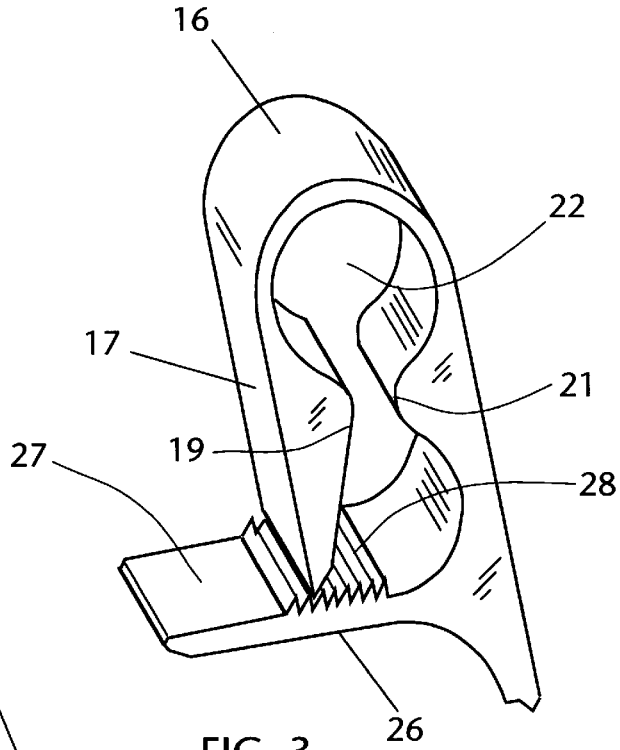
FIG. 3 is a fragmentary perspective view of the clamping portion of the shower curtain control device.

The leg 18 is joined contiguously to the tail portion 13, whereby the angular disposition of the tail portion 13 is determined by the angle at which the clamping mechanism 11 is secured to the rod 14, as will be described below. The other leg 17 terminates in a detent tip 23. A detent lever 26 extends transversely from the conjunction of the leg 18 and tail portion 13 toward the detent tip 23, the detent lever being resilient and slightly bendable by virtue of its shape and choice of materials. The detent lever includes a distal end portion 27 formed as a release tab, and an array of closely spaced, ridge-like detent teeth 28 extending from a medial portion of the lever 26 toward the detent tip 23. With reference also to FIG. 3, the teeth 28 are dimensioned to engage the detent tip 23 when the lever 27 is in a quiescent, undeflected state. The teeth are disposed within a range defined by positions of the detent tip 23 when the leg 17 is bent from zero deflection to a maximum expected inward deflection, as explained below. The teeth 28 will thus retain the leg 17 at any such deflection. Moreover, a slight bending or deflection of the lever 27 may release the detent tip 23 from the teeth 28 and allow the leg 17 to return elastically to its undeflected state.

Figure 6:
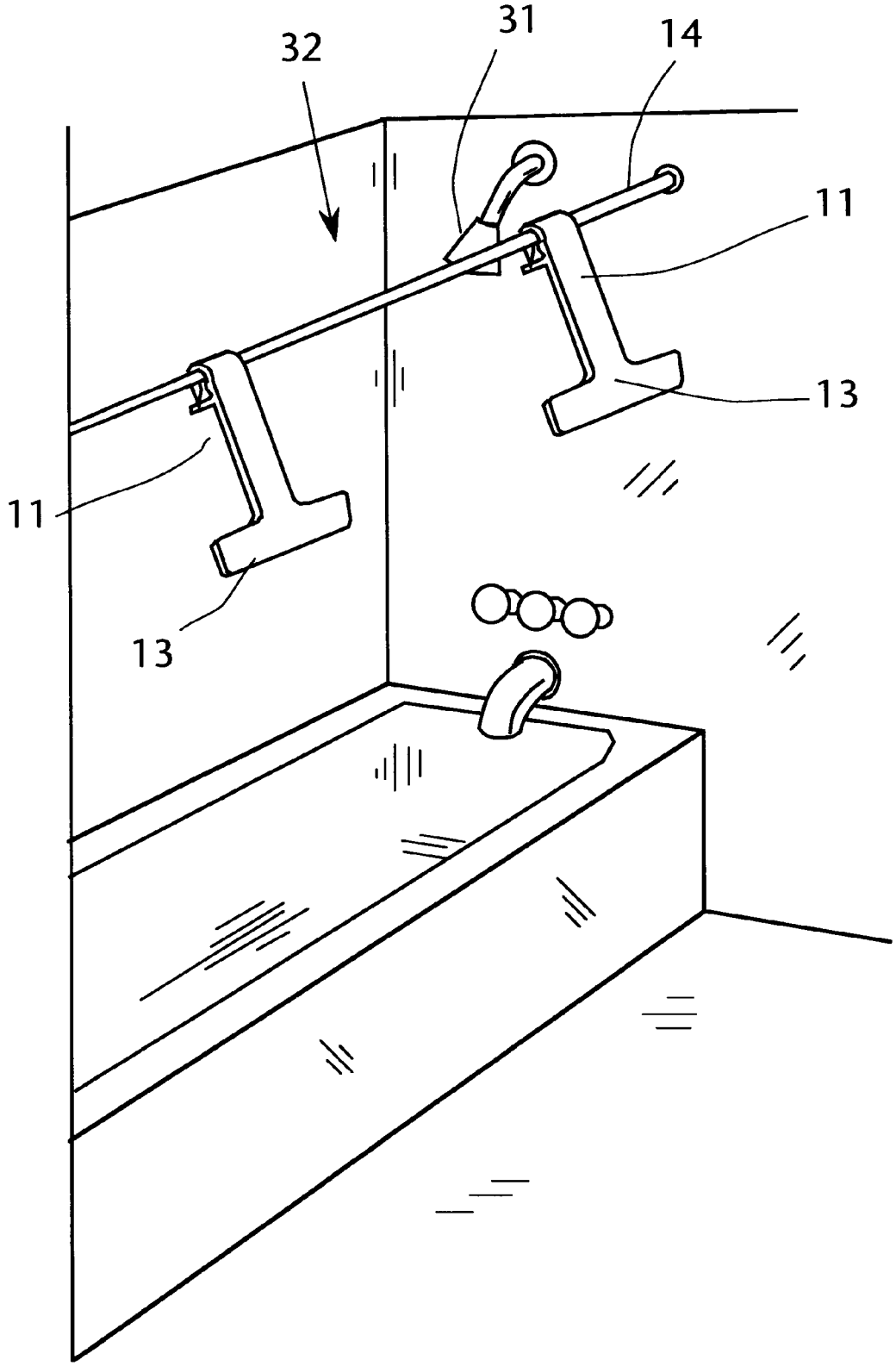
FIG. 6 is a perspective view of a typical shower enclosure, showing the use of the shower curtain control device.
Figure 7:
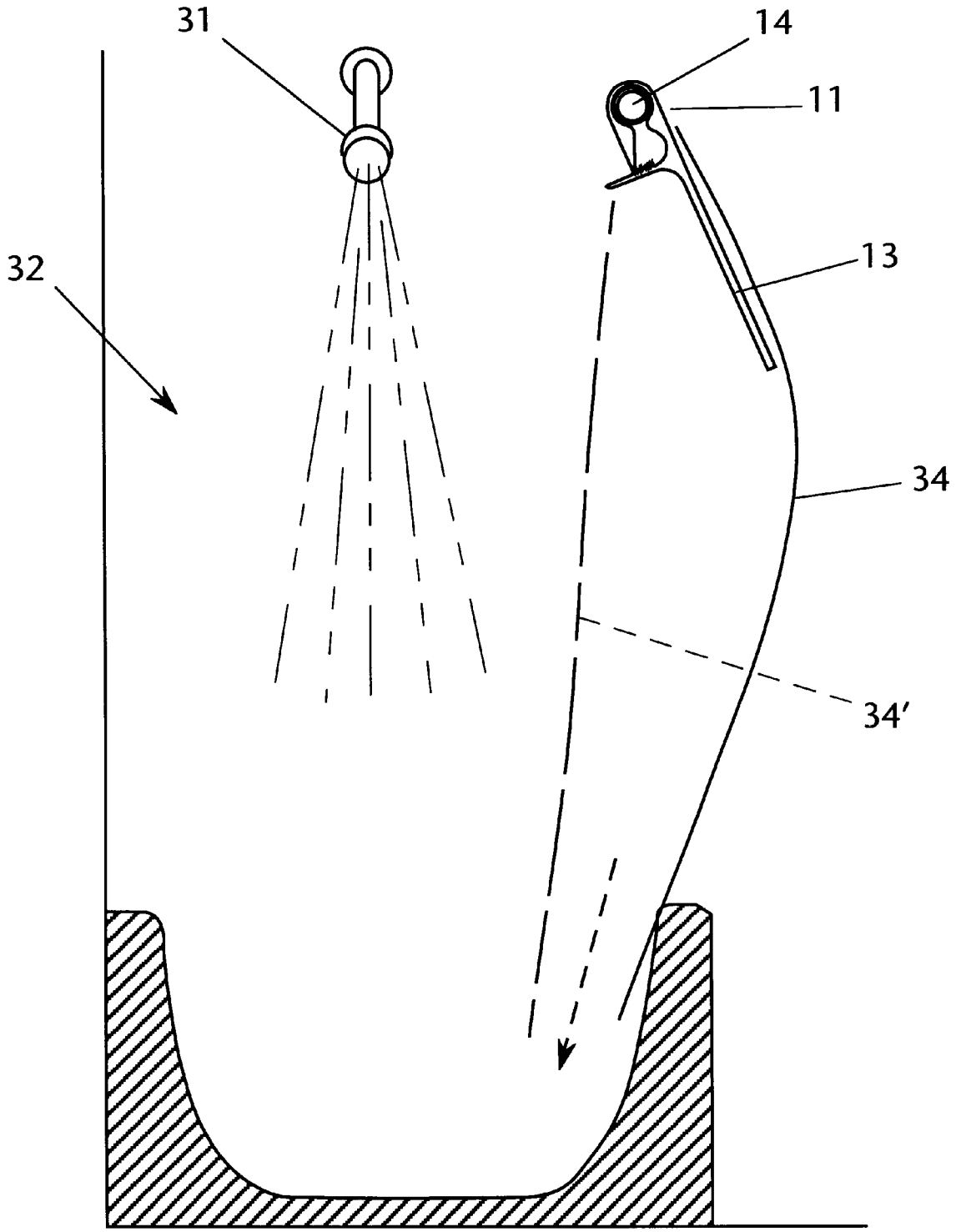
FIG. 7 is an end elevation of the typical shower enclosure as in FIG. 6, showing the use of the shower curtain control device.

With regard to FIGS. 6 and 7, a typical shower installation includes a shower head 31 directed into a shower enclosure 32. A shower curtain rod 14 extends across an opening in the enclosure 32 (a curtain rod ring may define and circumscribe some or all of the enclosure 32), to support a shower curtain 34. To prevent the curtain 34 from intruding into the enclosure 32, one or more shower curtain control devices 11 are secured to the rod 14. Each device 11 may be installed by bending leg 17 outwardly sufficiently to place the rod 14 in the receptacle 22. The receptacle 22 is dimensioned to be freely translating along and freely rotating about the rod 14, so that the devices 11 may be moved together with the shower curtain along the rod 14.

Figure 4:
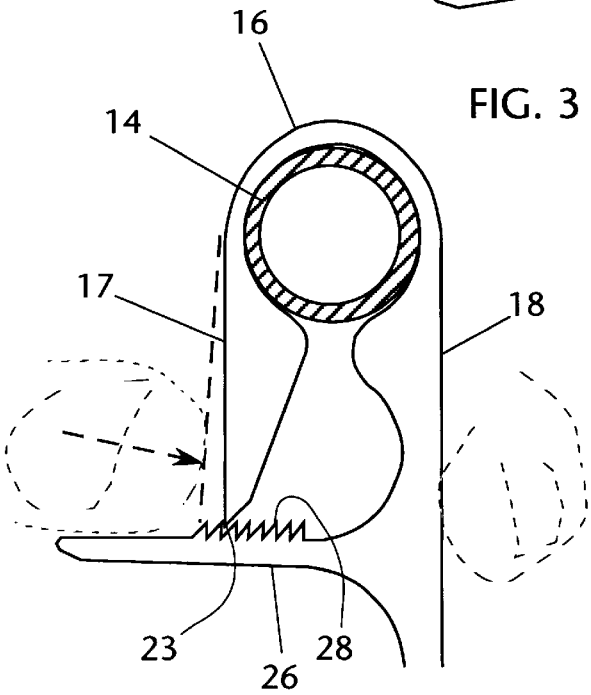
FIG. 4 is an enlarged side view showing manual engagement of the clamping portion of the shower curtain control device depicted in FIGS. 1–3.

To control the intrusion of the shower curtain 34 into the enclosure 32, each device 11 is clamped in place on the rod 14 when the curtain 34 has been closed to establish the enclosure. Each device 11 may be rotated about the rod 14 outwardly of the enclosure, as shown in FIG. 7, so that the tail portion 13 impinges on the curtain and urges it outwardly, thereby redirecting the curtain from its typical intrusive position 34'. With regard to FIG. 4, the legs 17 and 18 are squeezed together to reduce the diameter of the receptacle 22 and frictionally engage the rod 14. The teeth 28 engage the detent tip 23 at the desired clamping position, and the tail portion 13 is secured in its outwardly diverging orientation.

Figure 5:
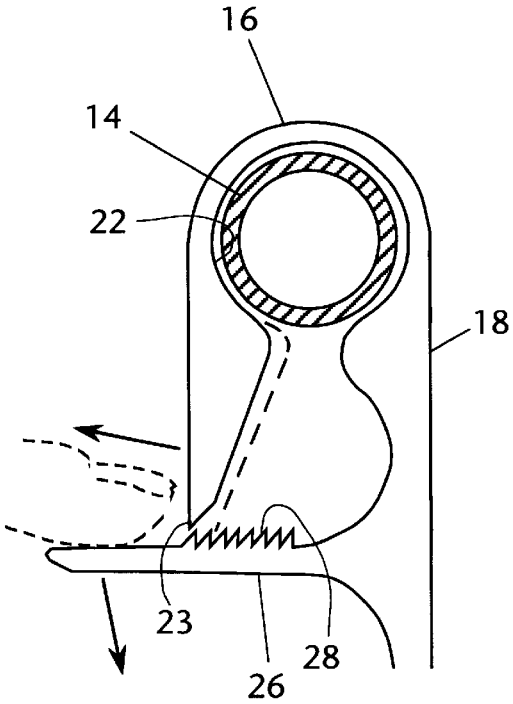
FIG. 5 is an enlarged side view showing manual release of the clamping portion of the shower curtain control device depicted in FIGS. 1–4.

To release the device 11, as when the shower is ended and the curtain is opened, the user may deflect the lever 27, as shown in FIG. 5, by slight finger pressure, whereby the teeth 28 release the detent tip 23. The frictional engagement by receptacle 22 is released immediately, and the clamping mechanism once more is free to slide or rotate on the rod 14. The tail portion is thus released from the outward angular displacement of FIG. 7, and is free to hang downwardly and to slide along the curtain rod 14; e.g., if the curtain is slidably translated to open the enclosure.

In using the device 11, the clamping mechanism is easily used without risking exerting too much pressure on the shower curtain rod. Moreover, there is no need to handle the tail portion, which forms no active part of the clamping mechanism.

The tail portion has been depicted with an inverted T configuration of any practical length and width to control the shower curtain. Alternatively, the tail portion may comprise any desirable shape having a longitudinal extent sufficient to engage the shower curtain and hold it outwardly from the shower area.

A good material for forming all or parts of the device 11 is Delrin or similar plastic, which provides high mildew resistance, easy injection molding, non-hygroscopic, and low outgassing properties.

The foregoing description of the preferred embodiment of the invention has been presented for purposes of illustration and description. It is not intended to be exhaustive or to limit the invention to the precise form disclosed, and many modifications and variations are possible in light of the above teaching without deviating from the spirit and the scope of the invention. The embodiment described is selected to best explain the principles of the invention and its practical application to thereby enable others skilled in the art to best utilize the invention in various embodiments and with various modifications as suited to the particular purpose contemplated. It is intended that the scope of the invention be defined by the claims appended hereto.

I claim:

1. A shower curtain control device, including:

clamping means for releasably engaging a shower curtain rod on which a shower curtain is suspended;

impinging means extending from said clamping means and disposed to impinge on the shower curtain and control the angle at which the shower curtain is suspended from the shower curtain rod;

said clamping means including adjustable friction means for frictionally engaging the shower curtain rod, and means for selectively controlling and releasing said adjustable friction means;

said clamping means including a clamp having an inverted U configuration, said clamp having a receptacle for receiving the shower curtain rod therethrough; a pair of legs extending from said inverted U configuration, one of said pair of legs being secured to said impinging means;

said means for selectively controlling including a detent lever extending from said one leg toward the other of said pair of legs, said other leg including a distal end, and a detent tip formed at said distal end of said other leg, and a plurality of detent teeth extending from said detent lever and disposed to engage said detent tip.

2. The shower curtain control device of claim 1, wherein said other leg is resiliently deflectable toward said one leg, and said detent teeth are arrayed in an expected range of position of said detent tip during deflection of said other leg, whereby said detent tip may be releasably secured by said detent teeth throughout said range of position.

3. The shower curtain control device of claim 2, wherein said detent lever includes a distal end, and release tab means formed at said distal end of said detent lever to receive manual pressure and deflect said detent lever to release said detent tip from said detent teeth.

4. The shower curtain control device of claim 1, wherein said impinging means includes a tail portion having length and width dimensions greater than said clamping means.

5. The shower curtain control device of claim 4, wherein said tail portion includes an inverted T configuration.

6. The shower curtain control device of claim 1, wherein said detent lever and said impinging means are integrally formed with said clamping means.

7. A shower curtain control device, including:

clamping means for releasably engaging a shower curtain rod on which a shower curtain is suspended;

impinging means for controlling the angle at which the shower curtain is suspended from the shower curtain rod, said impinging means extending from said clamping means and disposed to impinge on the shower curtain;

said clamping means including adjustable friction means for engaging the shower curtain rod, and means for selectively controlling and releasing said adjustable friction means;

said means for selectively controlling and releasing including a finger release tab, said finger release tab being fixed at one end to said clamping means and deflectable at its opposed end, said opposed end of said finger release tab being deflectable by manual pressure to release said adjustable friction means.

8. A shower curtain control device, including:

clamping means for releasably engaging a shower curtain rod on which a shower curtain is suspended;

impinging means for controlling the angle at which the shower curtain is suspended from the shower curtain rod, said impinging means extending from said clamping means and disposed to impinge on the shower curtain;

said clamping means including adjustable friction means for frictionally engaging the shower curtain rod, and means for selectively controlling and releasing said adjustable friction means;

said clamping means including a pair of legs joined in inverted U configuration and defining therebetween a receptacle for receiving the shower curtain rod therethrough;

said means for selectively controlling including a detent lever extending from one of said pair of legs toward the other of said pair of legs, a plurality of detent teeth formed on said detent lever, said other leg including a distal end disposed to engage said detent teeth.

* * * * *